US007614499B2

(12) United States Patent
Müller

(10) Patent No.: US 7,614,499 B2
(45) Date of Patent: Nov. 10, 2009

(54) PACKAGING UNIT WITH SLIDABLE CASING

(75) Inventor: Asmus Müller, Karlsruhe (DE)

(73) Assignee: Robert Bosch GmbH, Stuttgart (DE)

( * ) Notice: Subject to any disclaimer, the term of this patent is extended or adjusted under 35 U.S.C. 154(b) by 180 days.

(21) Appl. No.: 11/378,787

(22) Filed: Mar. 16, 2006

(65) Prior Publication Data

US 2006/0213799 A1 Sep. 28, 2006

(30) Foreign Application Priority Data

Mar. 22, 2005 (DE) ..... 10 2005 013 147

(51) Int. Cl.
*B65D 73/00* (2006.01)
*B65D 85/68* (2006.01)
*B65D 5/38* (2006.01)

(52) U.S. Cl. ..... 206/468; 206/335; 229/125.125

(58) Field of Classification Search ..... 206/335, 206/349–371, 461–471, 525; 229/125.125
See application file for complete search history.

(56) References Cited

U.S. PATENT DOCUMENTS 2,722,361 A * 11/1955 Kindseth ..... 229/125.125
2,751,135 A 6/1956 Kessler
3,395,849 A * 8/1968 Gillam ..... 229/125.125
3,568,827 A * 3/1971 Haring ..... 229/125.125
4,058,211 A 11/1977 Barbieri et al.
4,279,373 A * 7/1981 Montealegre ..... 229/125.125
5,027,947 A * 7/1991 Reighart ..... 206/335
5,105,939 A * 4/1992 Ralston, Jr. ..... 206/349
5,555,979 A * 9/1996 Baas et al. ..... 229/87.01
6,168,020 B1 * 1/2001 Niedzwiedz ..... 206/335
6,390,299 B1 5/2002 Mellon et al.

FOREIGN PATENT DOCUMENTS

DE 8104373 10/1983
DE 296 12 935 1/1998

* cited by examiner

*Primary Examiner*—Bryon P Gehman
(74) *Attorney, Agent, or Firm*—Kenyon & Kenyon LLP

(57) ABSTRACT

A packaging unit is provided, especially for a wiper blade. The packaging unit has a container for receiving at least one object and a casing that is able to be slid over the container, the casing covering the container at least partially. The casing has a section having a narrowed cross section, so that, in the area of the section, the casing exerts a clamping force on the container.

3 Claims, 3 Drawing Sheets

PACKAGING UNIT WITH SLIDABLE CASING

FIELD OF THE INVENTION

The present invention relates to a packaging unit, especially for wiper blades for window panes of motor vehicles.

BACKGROUND INFORMATION

A packaging unit for wiper blades is described, for instance, in German Patent Application No. DE 296 12 935. In that case, there is a container, made of transparent plastic, to receive the wiper blades, over which a casing made of cardboard is slid, the casing having printed on it the essential information about the manufacturer, the type of wiper blade and other items. In this context, container and casing each have an opening on a tab for hanging it up, and in the state where the casing is slid onto the container, the openings coincide one over the other, so that the packaging unit securely hangs up on a merchandise suspension mount. In order for the casing to be slid on, a certain clearance has to be present between packaging and casing. Because of the clearance, the frictional closure between packaging and casing is not always sufficient, in this connection, so as to ensure that, when the packaging unit is held vertically by the casing, the container does not slip out of the casing in a downward direction. This danger exists particularly when the retail customer grabs the packaging unit by the casing using little force, and hangs it up on, or takes it down from the merchandise suspension mount.

SUMMARY OF THE INVENTION

The packaging unit according to the present invention has the advantage that the clamping force, created at the section having the narrowed cross section, generates a friction locking between the container and the casing which is sufficient for preventing the slipping out of the container from the casing, when the packaging unit is held vertically. This minimizes the risk that the container slips out downwards when the retail customer takes down the packaging unit from the merchandise suspension mount, and that, in the process, the packaged item is damaged by falling.

A particularly effective clamping force of the casing to the container is achieved if the section having the narrowed cross section is developed by reducing the width at the rear panel of the casing. The reduced width of the casing is advantageously produced at the punched blank in that the section having the reduced width at the rear panel is developed by a fold profile that deviates from a straight fold profile. The deviating fold profile is expediently developed at the fold opposite an adhesive surface, by a deviating or bent scoring of the punched blank in the area of the section having the narrowed cross section. In this context, the deviating fold profile has an extension that runs essentially parallel to the remaining fold profiles, which makes up, for instance, ⅓ to 1/10 of the total extension of the casing. It is also expedient if the section having the narrowed cross section or the reduced width of the casing is developed in the half of the casing that points towards an eyelet or opening for hanging it up. Because of that, there is created, in the direction towards the opening, a slightly widened cross section, which makes it easier to slide the container into the casing.

DETAILED DESCRIPTION

Figure 1:
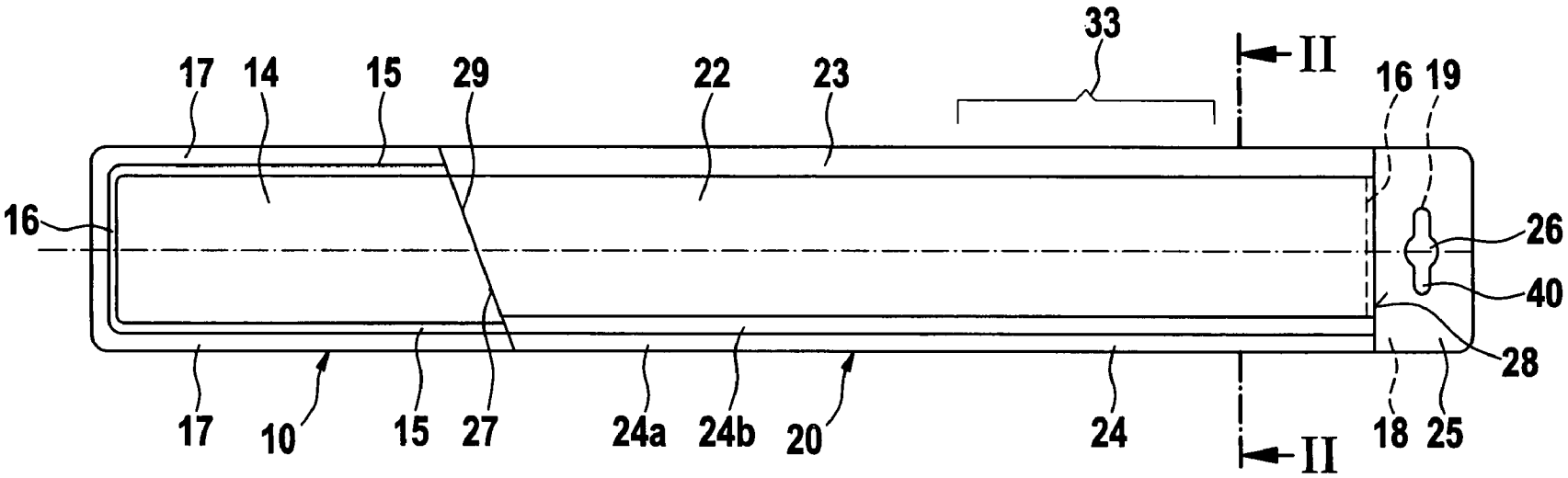
FIG. 1 shows a top view onto a packaging unit for a wiper blade.
Figure 2:
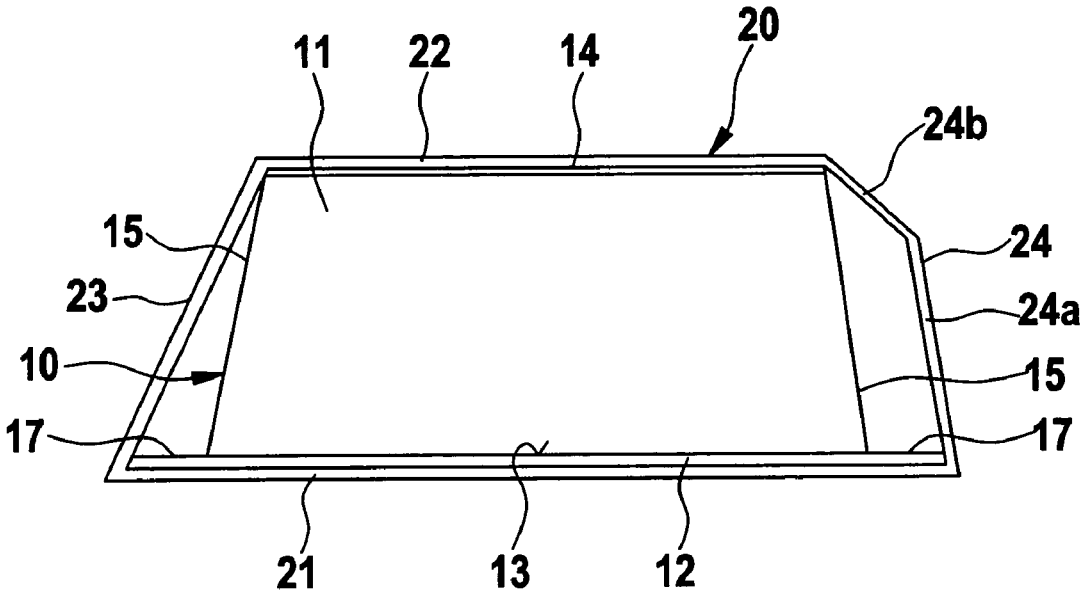
FIG. 2 shows a representation in section according to line II-II in FIG. 1.

The packaging unit shown in FIGS. 1 and 2 is made up of a container 10 and a casing 20. According to FIG. 2, container 10 has a tub-shaped receiving part 11 and a bottom part 12. Tub-shaped receiving part 11, which is expediently made of transparent plastic, has an open side 13, a front wall 14, two side walls 15 and two end faces 16. Open side 13 is furnished with an encircling edge 17 which becomes enlarged on one side to tab 18 that is shown covered. In tab 18 there is an eyelet 19 that is shown covered. Edge 17 and tab 18 are used as support for bottom part 12, which is made of sturdy cardboard, and is fastened to edge 17 and tab 18 by an adhesive. In tub-shaped receiving piece 11, the object, for instance two wiper blades, is visibly stored.

Casing 20, that may be slid over container 10, is preferably made of cardboard, and covers container 10 only partially, so that the packaged objects are at least partially visible. Casing 20 has a rear wall 21, a front wall 22, a first side-wall 23, a second sidewall 24 as well as a tab 25. At the end face opposite tab 25, casing 20 has a first end-face opening 27 and at the side of tab 25 itself a second end face opening 28. Opening 27 has a slantwise running bevel 29. At tab 25, an additional eyelet 26 is formed, which, together with eyelet 19 of container 10, forms a suspension opening 40 of the packaging unit. Second sidewall 24 has a first section **24*a* and a second section 24*b*. The partition of second sidewall 24 into two sections 24*a* and 24*b* is used to execute in an easily accessible manner sliding container 10 into opening 27 of casing 20, and at the same time to form a prestressing of casing 20. Using the slantwise running bevel 29, plugging on casing 20 having opening 27 onto container 10** is additionally made easier.

Figure 3:
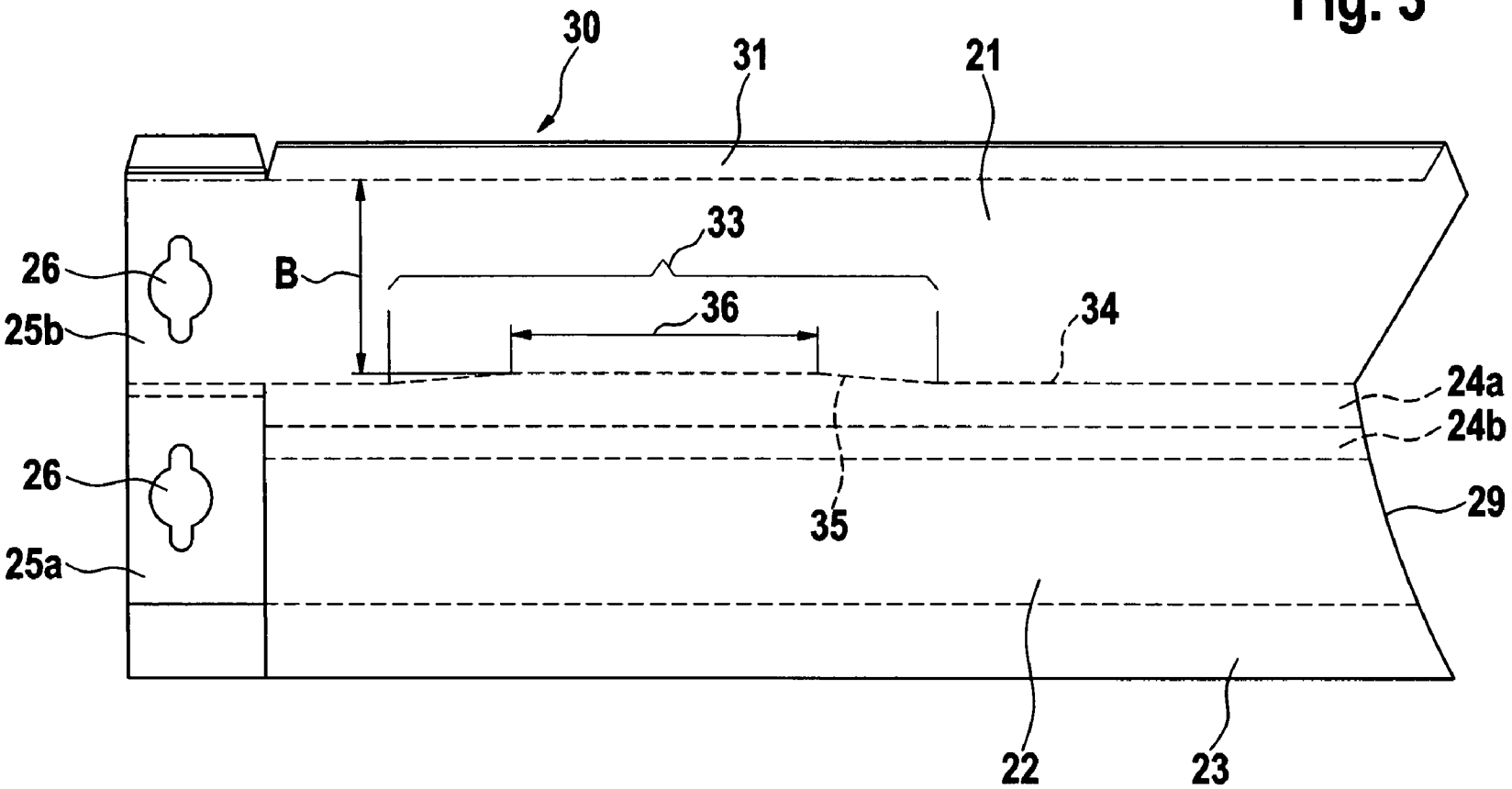
FIG. 3 shows a top view onto a punched blank of a casing of the packaging unit.

A punched blank 30 of casing 20, shown in FIG. 3, shows the wall sections and areas of casing 20, an adhesive area 31 being also visible, using which punched blank 30 is adhered together with casing 20. For the development of the edges of casing 20, punched blank 30 has folds shown by dashed lines. At rear wall 21, in this context, a section 33 having a reduced width B is formed. Reduced width B is developed at a fold 34, which forms the edge between rear wall 21 and sidewall 24, and which expediently lies opposite to adhesive area 31. In this context, reduced width B in section 33 is formed by a folding section 35 that deviates from the straight run of fold 34. Deviating fold profile 35 has an extension 36 that runs essentially parallel to the remaining fold profiles, which makes up, for instance, ⅓ to 1/10 of the total extension of the casing.

Section 33 is developed on casing 20 in the one-third with respect to the entire longitudinal extension of casing 20 that points towards eyelet 26, but at least in the one-half pointing towards eyelet 26. What is important is that, at opening 27 of casing 20 the cross section of casing 20 has no narrowing, so that it is easily possible to slide casing 20 onto container 10.

Because of reduced width B, in the region of section 33 a narrowed cross section of casing 20 is generated, which exerts a clamping force of casing 20 on container 10, which generates a frictional locking which, in turn, offers a sufficient carrying capacity of container 10, filled with objects, in casing 20 when casing 20 is held vertically. Because of the reduction of width B of casing 20 in the area in rear wall 21, the gapless force locking necessary for the frictional locking between casing 20 and container 10 is placed on the sturdiest side of container 10, namely on the rear side that is adhered to bottom part 12.

Tab 25 is formed, in punched blank 30 of casing 20, by two opposed tab parts 25*a* and 25*b*, which between them take up tab 18 of container 10 in the slid-in state of casing 20. Thereby eyelets 19 and 26 come together coincidently, so that when it is hanged up, the packaging unit is hanged up both using container 10 and casing 20.

What is claimed is:

1. A packaging unit comprising:

a container for receiving at least one object; and a casing adapted to be slid over the container and to cover the container at least partially, the casing including a section having a narrowed cross section, in such a way that, in an area of the section, a clamping force of the casing acts on the container, wherein the section having the narrowed cross section is formed by a lesser width of the casing at a rear wall, wherein the casing is formed from a punched blank, the section having the narrowed cross section being formed by the lesser width at the rear wall by a fold profile deviating from a straight fold;

wherein the fold profile that deviates from the straight fold is situated on a fold lying opposite to an adhesion surface; and wherein the deviating fold profile has an extension that runs substantially parallel to remaining fold profiles and that makes up about ⅓ to 1/10 of a total extension of the casing.

2. The packaging unit according to claim 1, wherein the section is situated on one-half of the casing pointing towards a tab having an eyelet as an opening for a suspension of the packaging unit.

3. The packaging unit according to claim 1, wherein the packaging unit is for a wiper blade.

* * * * *